US009342000B2

(12) United States Patent
Sugiyama

(10) Patent No.: US 9,342,000 B2
(45) Date of Patent: May 17, 2016

(54) IMAGE-FORMING APPARATUS AND METHOD WHICH STARTS SUPPLY OF RECORDING MATERIAL OR ALLOWS RECORDING MATERIAL SUPPLY TO IMAGE FORMING UNIT AT TIMING DEPENDENT ON DUTY RATIO OF HEATER

(71) Applicant: CANON KABUSHIKI KAISHA, Tokyo (JP)

(72) Inventor: Yuki Sugiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/467,267

(22) Filed: Aug. 25, 2014

(65) Prior Publication Data

US 2015/0071670 A1 Mar. 12, 2015

(30) Foreign Application Priority Data

Sep. 6, 2013 (JP) ..... 2013-184681

(51) Int. Cl.
*G03G 15/20* (2006.01)
*G03G 15/00* (2006.01)

(52) U.S. Cl.
CPC ..... *G03G 15/205* (2013.01); *G03G 15/6564* (2013.01); *G03G 2215/2035* (2013.01)

(58) Field of Classification Search
CPC ..... G03G 15/2039; G03G 15/205; G03G 15/2078; G03G 15/80; G03G 15/6564; G03G 2215/00599
USPC ..... 399/69, 70, 88, 328, 329; 219/110, 216, 219/482, 497
See application file for complete search history.

(56) References Cited

U.S. PATENT DOCUMENTS 5,656,187 A 8/1997 Miyamoto et al.
7,187,882 B2 * 3/2007 Kawazu et al. ..... 399/69
7,619,185 B2 * 11/2009 Ichino ..... 219/494
(Continued)

FOREIGN PATENT DOCUMENTS

JP 02143281 A * 6/1990
JP 8-30125 A 2/1996
(Continued)

OTHER PUBLICATIONS

U.S. Appl. No. 14/503,701, filed Oct. 1, 2014, to Osamu Nagasaki, et al.

*Primary Examiner* — Robert Beatty
(74) *Attorney, Agent, or Firm* — Fitzpatrick, Cella, Harper & Scinto

(57) ABSTRACT

An image-forming apparatus supplies power to a heater at the smaller duty ratio of: an upper-limit duty ratio which is set according to the current detected by an inlet current detecting unit in a warm-up period of a fixing unit; and a duty ratio which is continuously corrected according to a change in a heater resistance value and is required for supplying a predetermined target power to the heater. By this arrangement, the image-forming apparatus can output a first page of recording material in a short period time so that a current consumption of the entire apparatus does not exceed rated current consumption.

7 Claims, 11 Drawing Sheets

(56) References Cited

U.S. PATENT DOCUMENTS

| | | | | |
|---|---|---|---|---|
| 8,818,229 | B2 * | 8/2014 | Aoki | 399/88 |
| 9,041,942 | B2 * | 5/2015 | Takahashi et al. | 358/1.13 |
| 2009/0245847 | A1 * | 10/2009 | Yuda | 399/88 |
| 2012/0263486 | A1 * | 10/2012 | Aiko | 399/67 |
| 2013/0243464 | A1 * | 9/2013 | Odaka | 399/67 |

FOREIGN PATENT DOCUMENTS

| | | | | |
|---|---|---|---|---|
| JP | 2004045687 | A | * | 2/2004 |
| JP | 2004-233745 | A | | 8/2004 |
| JP | 2009-069426 | A | | 4/2009 |
| JP | 2012-053482 | A | | 3/2012 |

* cited by examiner

IMAGE-FORMING APPARATUS AND METHOD WHICH STARTS SUPPLY OF RECORDING MATERIAL OR ALLOWS RECORDING MATERIAL SUPPLY TO IMAGE FORMING UNIT AT TIMING DEPENDENT ON DUTY RATIO OF HEATER

BACKGROUND OF THE INVENTION

1. Field of the Invention

The present invention relates to an image-forming apparatus of an electrophotographic system, such as a laser printer or a copying machine.

2. Description of the Related Art

In recent years, in an image-forming apparatus of an electrophotographic system, there is a need to shorten the first print out time (FPOT) taken until the first page of a recording material is output after a print command is issued. In order to shorten the FPOT, it is necessary to shorten the time (warm-up time) required for warming up a fixing unit that is mounted on the image-forming apparatus. Although the warm-up time of the fixing unit may be shortened by supplying power that is as large as possible to a heater of the fixing unit in a warm-up period, the heater may be damaged if excessively large power is supplied to the heater. Thus, constant power may be supplied to the heater in the warm-up period. However, the resistance value of the heater generally changes with temperature. Such characteristics are referred to as the temperature coefficient of resistance (TCR). When the resistance value of the heater changes with temperature, the power supplied to the heater changes even if the duty ratio of power supplied to the heater is constant. Thus, when the heater has a positive temperature coefficient of resistance, for example, the power supplied to the heater decreases gradually and the warm-up time increases. Japanese Patent Application Publication No. H8-30125 discloses correcting the duty ratio according to the TCR of a heater so that constant power can be supplied to the heater in a warm-up period. However, in recent image-forming apparatuses, current consumption of an entire apparatus, including peripheral devices, tends to increase due to an increase in the number of print-outs per unit time, an increase in the number of peripheral devices (optional devices) connected to the image-forming apparatus, and the like. In such an image-forming apparatus, which consumes a large amount of current, as described above, when constant power is supplied to the heater, the current consumption of the entire apparatus may exceed the rated current 15 A.

SUMMARY OF THE INVENTION

An object of the present invention is to provide an image-forming apparatus capable of outputting the first page of a recording material in a short time while preventing the current consumption of the entire apparatus from exceeding the rated current.

Another object of the present invention is to provide an image-forming apparatus comprising an image forming unit that forms a toner image on a recording material, a fixing unit that has a heater, the resistance value of which changes with an increase in temperature, and heats and fixes the toner image formed on the recording material to the recording material, a control unit that controls the apparatus, an inlet current detecting unit that detects current flowing into the entire apparatus, and a heater current detecting unit that detects current flowing into the heater. When warming up the fixing unit to a fixable temperature, the control unit supplies power to the heater with the smaller duty ratio of: an upper-limit duty ratio D15a of power supplied to the heater, the ratio being determined so that the current detected by the inlet current detecting unit does not exceed a predetermined current; and a duty ratio Dn, which is determined based on the resistance value of the heater corresponding to the temperature of the heater and the current detected by the heater current detecting unit and which is continuously corrected according to a change in the resistance value and is required for supplying predetermined target power. Another object of the present invention is to provide an image-forming apparatus comprising an image forming unit that forms a toner image on a recording material, a fixing unit that has a heater, the resistance value of which changes with an increase in temperature, and heats and fixes the toner image formed on the recording material to the recording material, a control unit that controls the apparatus, and a heater current detecting unit that detects current flowing into the heater. When warming up the fixing unit to a fixable temperature, the control unit supplies power to the heater at a duty ratio Dn, which is determined according to a resistance value of the heater corresponding to the temperature of the heater and the current detected by the heater current detecting unit and which is required for supplying a predetermined target power. The duty ratio Dn is corrected continuously according to a change in the resistance value during a warm-up period.

Another object of the present invention is to provide a method of supplying power comprising an inlet current detecting step of detecting current flowing into an entire apparatus, a heater current detecting step of detecting current flowing into the heater, a step of determining an upper-limit duty ratio D15a of power supplied to the heater, the ratio being determined so that the current detected in the inlet current detecting step does not exceed a predetermined current, a step of determining a duty ratio Dn which is determined based on the resistance value of the heater corresponding to the temperature of the heater and the current detected in the heater current detecting step and which is continuously corrected according to a change in the resistance value and is required for supplying predetermined target power, and a step of warming up the fixing unit to a fixable temperature at the smaller duty ratio of: the upper-limit duty ratio D15a and the duty ratio Dn. Another object of the present invention is to provide a method of supplying power comprising a heater current detecting step of detecting current flowing into the heater, a step of determining a duty ratio Dn which is determined based on the resistance value of the heater corresponding to the temperature of the heater and the current detected in the heater current detecting step and which is required for supplying predetermined target power, and a step of supplying power to the heater while correcting the duty ratio Dn continuously according to the change in the resistance value in a period in which the fixing unit is warmed up.

Another object of the present invention is to provide a method of determining a timing at which a recording material is supplied comprising an inlet current detecting step of detecting current flowing into an entire apparatus, a heater current detecting step of detecting current flowing into a heater of a fixing unit that is mounted on the image-forming apparatus, a step of determining an upper-limit duty ratio D15a of power supplied to the heater, the ratio being determined so that the current detected in the inlet current detecting step does not exceed a predetermined current, a step of determining a duty ratio Dn which is determined based on the resistance value of the heater corresponding to the temperature of the heater and the current detected in the heater current detecting step and which is continuously corrected according to a change in the resistance value and is required for supplying predetermined target power, and step of starting the supply of the recording material to the image forming unit at a predetermined timing when the duty ratio Dn is equal to or smaller than the upper-limit duty ratio D15a and starting the supply of the recording material to the image-forming apparatus at a timing later than the predetermined time when the duty ratio Dn is larger than the upper-limit duty ratio D15a.

Further features of the present invention will become apparent from the following description of exemplary embodiments (with reference to the attached drawings).

DESCRIPTION OF THE EMBODIMENTS

Hereinafter, the implementation of the present invention will be described in detail based on embodiments with reference to the diagrams discussed below. However, the dimensions, the materials, the shapes, the relative positions, and the like of constituent components described in the embodiment are changed appropriately according to a configuration and various conditions of an apparatus to which the present invention is applied. That is, the scope of the present invention is not limited to the following embodiments.

First Embodiment

[Configuration of Image-Forming Apparatus]

Figure 1:
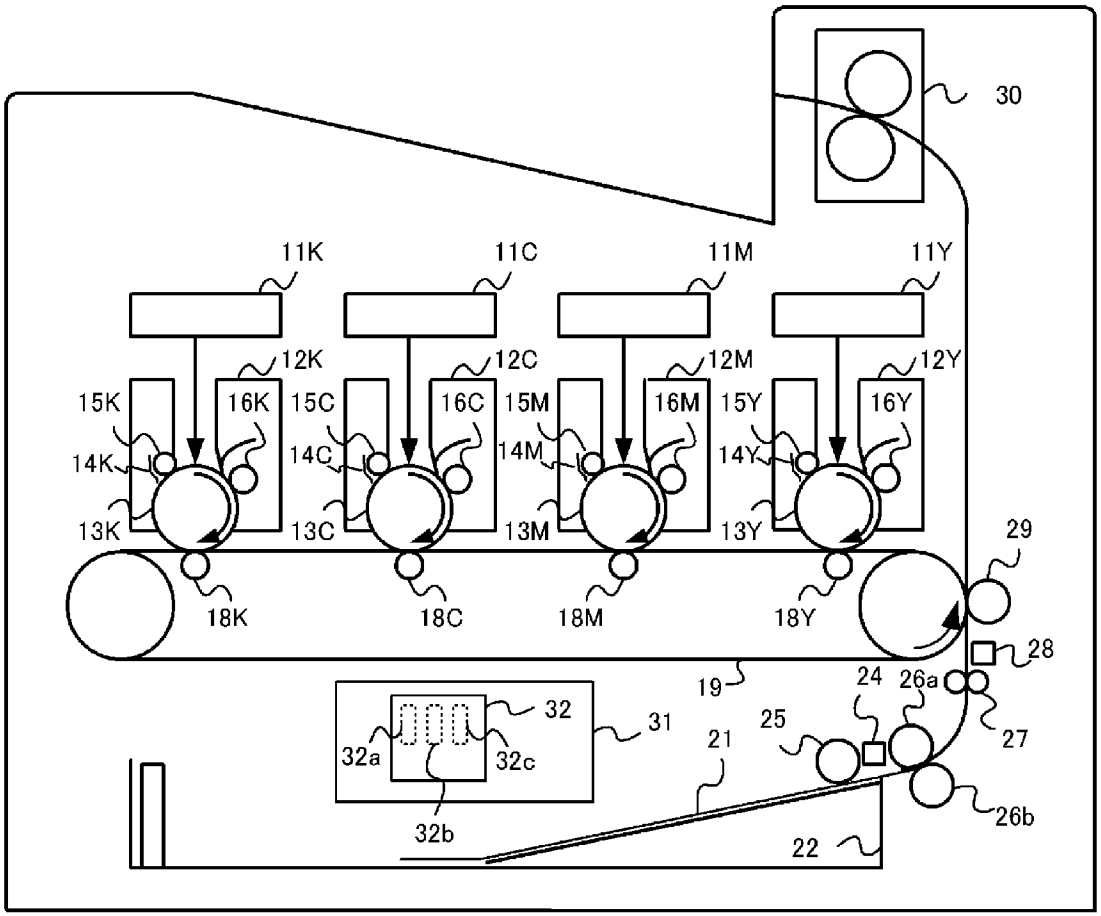
FIG. 1 is a schematic cross-sectional view of an image-forming apparatus according to an embodiment of the present invention.

Referring to FIG. 1, the overall configuration of an image-forming apparatus according to an embodiment of the present invention will be described. FIG. 1 is a schematic cross-sectional view illustrating the overall configuration of a tandem-type full-color laser beam printer (hereinafter, an image-forming apparatus) using an electrophotographic process, which is an example of an image-forming apparatus according to the present embodiment. In the present embodiment, although a full-color laser beam printer including a plurality of photosensitive drums is employed, the present invention is not limited to this, but can be applied to a monochrome copying machine, a printer, a facsimile, and the like having one photosensitive drum.

A tandem-type color image-forming apparatus is configured to output a full-color image by superimposing toner of the four colors yellow (Y), magenta (M), cyan (C), and black (K). In order to form images of respective colors, laser scanners 11Y, 11M, 11C, and 11K and cartridges 12Y, 12M, 12C, and 12K are provided. The cartridges 12Y to 12K are formed of developing devices having photosensitive members 13Y, 13M, 13C, and 13K, photosensitive member cleaners 14Y, 14M, 14C, and 14K, charging rollers 15Y, 15M, 15C, and 15K, and developing rollers 16Y, 16M, 16C, and 16K, respectively. Further, an intermediate transfer belt 19 is provided in contact with the photosensitive members 13Y to 13*k* of the respective colors, and primary transfer rollers 18Y, 18M, 18C, and 18K are respectively provided so as to face the photosensitive members 13Y to 13K with the intermediate transfer belt 19 interposed.

A sheet sensor 24 that detects the presence of a sheet 21 is provided in a cassette 22 that stores the sheet 21 as a recording material in a sheet feeding unit. Further, a sheet feeding roller 25, separation rollers 26*a* and 26*b*, and a registration roller 27 are provided in a transport path, and a registration sensor 28 is provided near the registration roller 27 on the downstream side of the registration sensor 28 in a sheet transport direction. Further, a secondary transfer roller 29 is arranged downstream in the transport path so as to make contact with the intermediate transfer belt 19, and a fixing unit 30 is arranged downstream the secondary transfer roller 29.

A controller 31, which is a control unit of a laser printer, includes a central processing unit (CPU) 32 that includes a ROM 32*a*, a RAM 32*b*, a timer 32*c*, and the like and various input-output control circuits (not illustrated).

[Electrophotographic Process]

Next, an electrophotographic process (image forming process) will be described briefly. In dark portions of the cartridges 12Y to 12K, the surfaces of the photosensitive members 13Y to 13K rotating in the direction indicated by arrows are uniformly charged by the charging rollers 15Y to 15K, respectively. Subsequently, the surfaces of the photosensitive members 13Y to 13K are irradiated by a laser beam that is modulated according to image data by the laser scanners 11Y to 11K, respectively, whereby charges formed in the portions irradiated with the laser beam are removed. In this way, electrostatic latent images are formed on the surfaces of the photosensitive members 13Y to 13K. In the developing device, by the action of a blade (not illustrated), toner on the developing rollers 16Y to 16K, on which a certain amount of toner layer adheres, is applied to the electrostatic latent images on the photosensitive members according to a developing bias. In this way, toner images of the respective colors are formed on the surfaces of the photosensitive members 13Y to 13K as an image bearing member.

The toner images formed on the surfaces of the photosensitive members 13Y to 13K are attracted to the intermediate transfer belt 19 according to a primary transfer bias in the nip portion between the intermediate transfer belt 19 and the photosensitive members 13Y to 13K. Further, the CPU 32 controls the timings at which image formation is performed in the respective cartridges 12Y to 12K, according to the timings corresponding to the belt transfer speed, and sequentially transfers the respective toner images to the intermediate transfer belt 19. In this way, a full-color image is finally formed on the intermediate transfer belt.

On the other hand, the sheets 21 in the cassette 22 are conveyed by the sheet feeding roller 25 and only one sheet 21 is allowed to pass through the nip formed by the registration roller 27 and an adjacent roller, by the separation rollers 26*a* and 26*b* and is conveyed to the secondary transfer roller 29. The toner image on the intermediate transfer belt 19 is transferred to the sheet 21 at the nip portion between the intermediate transfer belt 19 and the secondary transfer roller 29 located downstream of the registration roller 27. The sheet 21 to which the toner image is transferred is discharged outside the image-forming apparatus with the toner image being finally subjected to heating and fixing by a fixing unit (hereinafter referred to as a fixing unit 30) as fixing means. The constituent components associated with the electrophotographic process, except the fixing unit 30, form an image forming unit of the present invention.

[Fixing Unit]

Figure 2:
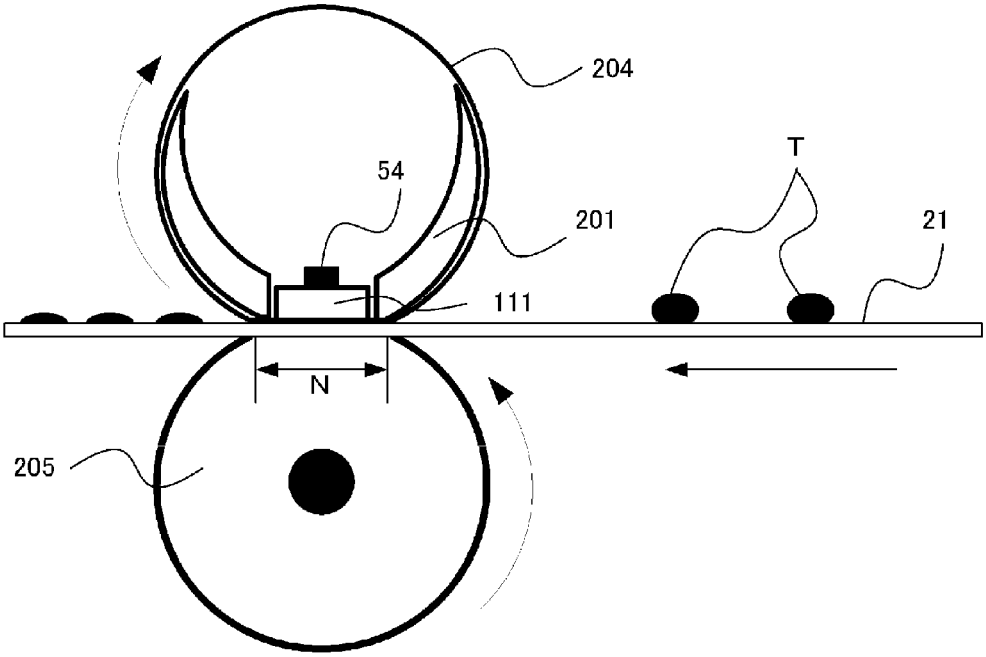
FIG. 2 is a diagram for illustrating a configuration of a fixing unit according to an embodiment of the present invention.

FIG. 2 is a schematic diagram for illustrating a configuration of the fixing unit 30 according to an embodiment of the present invention. In the present embodiment, a case where a pressure roller-driven film heating heater, using an endless film (cylindrical film) is employed as the fixing unit 30, will be described.

The fixing unit 30 includes a heater 111, a heater holder 201, a film (fixing film) 204, a pressure roller 205, a temperature detection device 54, and the like. The heater 111 is fixed and held by the gutter shaped heater holder 201 having heat resistance. The cylindrical film 204 is loosely fitted onto the heater holder 201 to which the heater 111 is attached. The pressure roller 205 is a rotatable pressuring member that makes pressure contact with the heater 111 with the fixing film 204 interposed to form the fixing nip N. The temperature detection device 54 is arranged so that a heat sensitive surface thereof makes contact with the surface of the heater 111. The heater 111 is a ceramic heater in which a heat generating resistor is printed on a ceramic substrate.

The pressure roller 205 is driven to rotate at a predetermined circumferential speed in a counterclockwise direction indicated by an arrow, by driving means. With a frictional force due to pressure contact at the fixing nip N between the pressure roller 205 and the fixing film 204, the rotating force of the pressure roller 205 acts on the cylindrical fixing film 204 so that the fixing film 204 is rotated. The fixing film 204 rotates around the heater holder 201 in a clockwise direction indicated by an arrow with the inner surface sliding in contact with the downward surface of the heater 111.

When current is allowed to pass through the heater 111 and power is supplied thereto, the temperature of the heater 111 increases and the temperature is controlled at a predetermined temperature. In this temperature-controlled state, a sheet 21 carrying a non-fixed toner image T is conveyed to the fixing nip N, and is continuously conveyed while pinching the fixing nip N together with the fixing film 204 with the toner image carrying surface of the sheet 21 at the fixing nip N, making close contact with the outer surface of the fixing film 204. In this pinching and conveying process, the heat of the heater 111 is transferred to the sheet 21 with the fixing film 204 interposed therebetween, and the non-fixed toner image T on the sheet 21 is heated and pressurized to be melted and fixed. The sheet 21 having passed through the fixing nip N separates curvedly from the fixing film 204.

Figure 3:
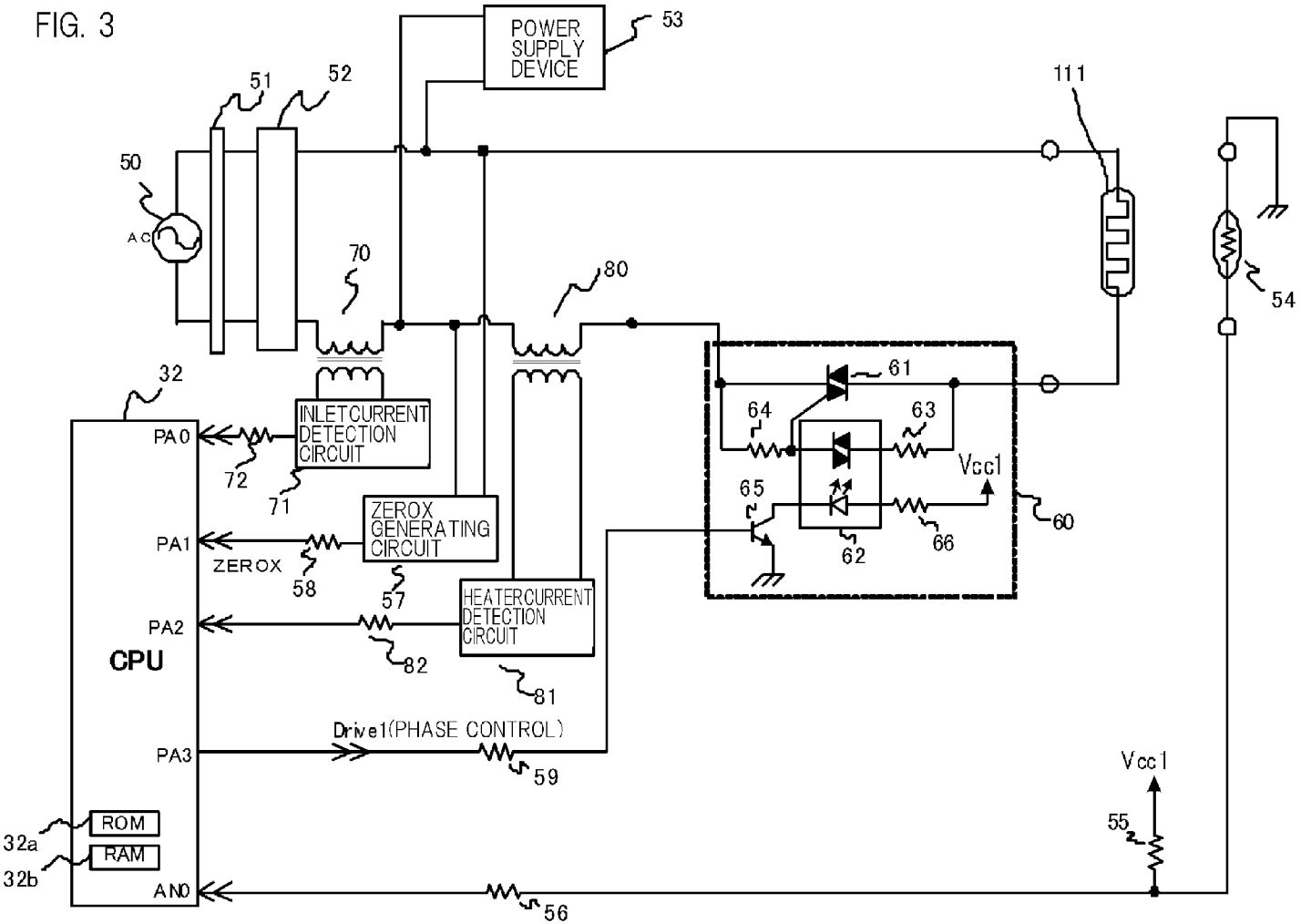
FIG. 3 is a diagram for illustrating a heater driving circuit according to an embodiment of the present invention.

A heater driving circuit according to the present embodiment will be described with reference to FIG. 3. FIG. 3 is a diagram for illustrating a heater driving circuit according to an embodiment of the present invention.

A commercial AC power supply 50 is connected to the image-forming apparatus. The image-forming apparatus is supplied with power from the commercial power supply via an inlet 51. The heater 111 of the fixing unit generates heat with the power supplied from the commercial power supply via an AC filter 52. A power supply device 53 is a power supply for driving a secondary-side load, such as a motor inside the apparatus. The power supply device 53 outputs a predetermined voltage to the secondary-side load. Moreover, the CPU (control unit) 32 is also used for controlling the driving of the heater and includes input and output ports, the ROM 32*a*, the RAM 32*b*, and the like.

The CPU 32 controls the power supplied to the heater by controlling a phase control circuit 60. A temperature detection device 54 disposed on the rear surface of the heater has one end connected to the ground and the other end connected to a resistor 55, and is connected to an analog input port AN0 of the CPU 32 with a resistor 56 interposed therebetween. The temperature detection device 54 has such characteristics that the resistance value decreases when the temperature increases. The CPU 32 detects the temperature of the heater by converting a voltage divided by the fixed resistor 55 and input to the input port AN0 into temperature according to a predetermined temperature table (not illustrated).

On the other hand, the current supplied via the AC filter 52 is input to a zero-cross generating circuit 57. The zero-cross generating circuit 57 is configured to output a High-level signal when the voltage of the commercial power supply is equal to or smaller than a threshold voltage set to approximately 0 V and to output a Low-level signal in other cases. A pulse signal having approximately the same cycle as the cycle of the commercial AC power supply is input to an input port PA1 of the CPU 32 via a resistor 58. The CPU 32 is used for detecting an edge at which a zero-cross signal changes from High to Low, to control the timings of phase control and switching control.

The CPU 32 determines the ON-timing for driving the phase control circuit 60 based on the temperature detected by the temperature detection device 54 and outputs a driving signal from a port PA3. First, the phase control circuit 60 will be described. When an output port PA3 outputs a High-level signal at the ON-timing, the signal is output to a transistor 65 via a base resistor 59 to turn on the transistor 65. When the transistor 65 is turned on, a phototriac coupler 62 is turned on. The phototriac coupler 62 is a device for securing the creepage distance between the primary and secondary sides, and a resistor 66 is used for limiting current flowing into a light-emitting diode inside the phototriac coupler 62.

Resistors 63 and 64 are bias resistors for a triac 61, and the triac 61 is turned on when the phototriac coupler 62 is turned on. The triac 61 is a device which, when triggered to be turned on, is latched to a conductive state until the AC voltage reaches 0 V. Thus, power corresponding to the ON-timing is supplied to the heater 111.

Current corresponding to the sum of the current input via the AC filter 52 and flowing into the power supply device and the current flowing into the heater 111 are input to an inlet current detection circuit (inlet current detecting unit) 71 via a current transformer 70 as current flowing into the inlet 51. In the inlet current detection circuit 71, the input current is transformed into a voltage. A current detection signal transformed into a voltage is input to a port PA0 of the CPU 32 via a resistor 72 as a signal indicating the current flowing into the entire apparatus, and is A/D converted and managed as a digital value.

Similarly, the current flowing into the heater 111 is input to a heater current detection circuit 81 via a current transformer 80. In the heater current detection circuit (heater current detecting unit) 81, the input current is transformed into a voltage. The current detection signal transformed into a voltage is input to a port PA2 of the CPU 32 via a resistor 82 and is A/D converted and managed as a digital value.

[Phase Control]

In the phase control of the present embodiment, the area of a half-cycle (half-wave of an AC waveform) of a commercial AC signal is evenly divided into 100 parts and the proportion (%) of ON parts (hereinafter referred to a duty ratio) is controlled, whereby the supplied power is controlled in 101 steps of 0 to 100%.

Figure 4:
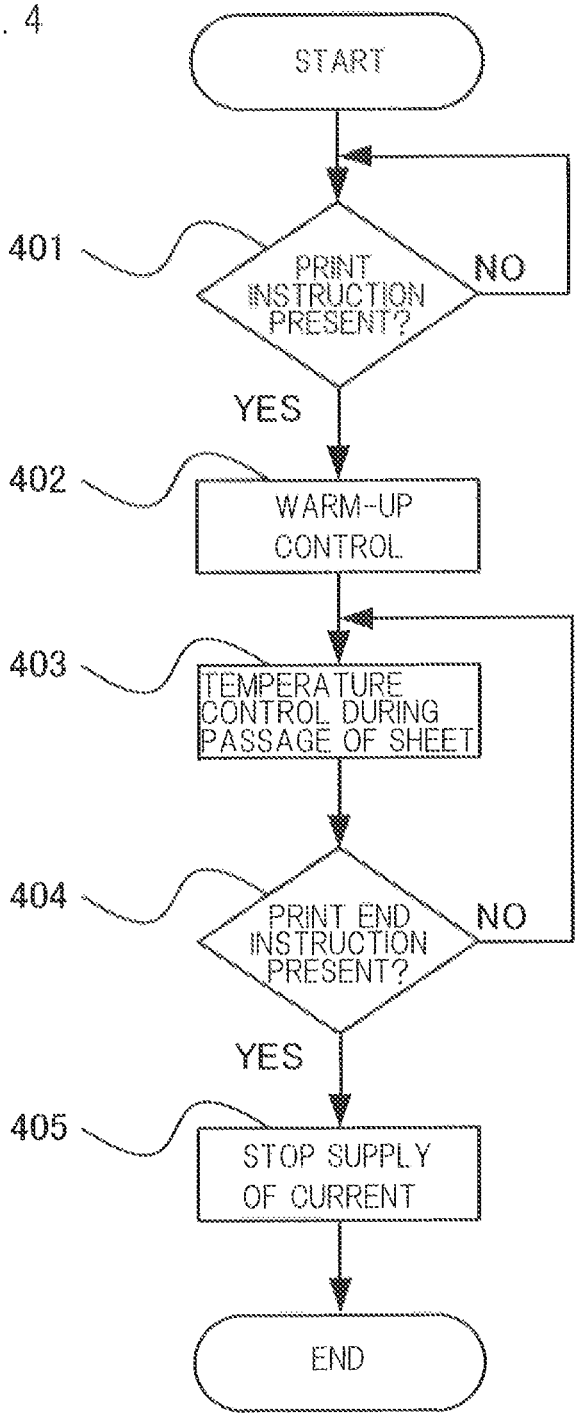
FIG. 4 is a diagram illustrating a control flow of a print operation according to an embodiment of the present invention.

FIG. 4 is a flowchart of a control flow of a print operation according to the first embodiment. The CPU 32 waits for a print instruction during a power-ON period (step 401) and starts warm-up control of increasing the temperature of the fixing unit 30 up to a temperature at which fixing can be realized upon receiving the print instruction (step 402). When warm-up control ends, control is performed so as to maintain the temperature of the fixing unit 30 to be constant (step 403). In the state of controlling the temperature at a predetermined level, a fixing process is performed on the sheet 21 to which a non-fixed toner image is transferred. After that, the temperature control during passage of the sheet is continued until printing ends (step 404), and the supply of current to the fixing unit 30 is stopped when a print end instruction is issued (step 405).

[Warm-Up Control]

Warm-up control of warming up the fixing unit to a fixable temperature will be described. In this example, the duty ratio of power supplied to the heater is continuously corrected according to the temperature so that the power supplied to the heater maintains target power even when the resistance value of the heater changes. Moreover, during the warm-up, the inlet current is continuously monitored and the duty ratio is limited so that the inlet current does not exceed 15 A. When it is determined that the target power can be supplied until the temperature of the fixing unit (heater) reaches the fixable temperature at a predetermined timing during the warm-up period, image formation (supply of sheet) is allowed to start immediately. On the other hand, when it is determined that it is not possible to supply the target power until the temperature of the fixing unit (heater) reaches the fixable temperature, image formation (supply of sheet) is allowed when the temperature of the fixing unit (heater) reaches a predetermined temperature (fixable temperature). That is, the supply of the sheet is allowed at a time later than a predetermined period.

Figure 6A:
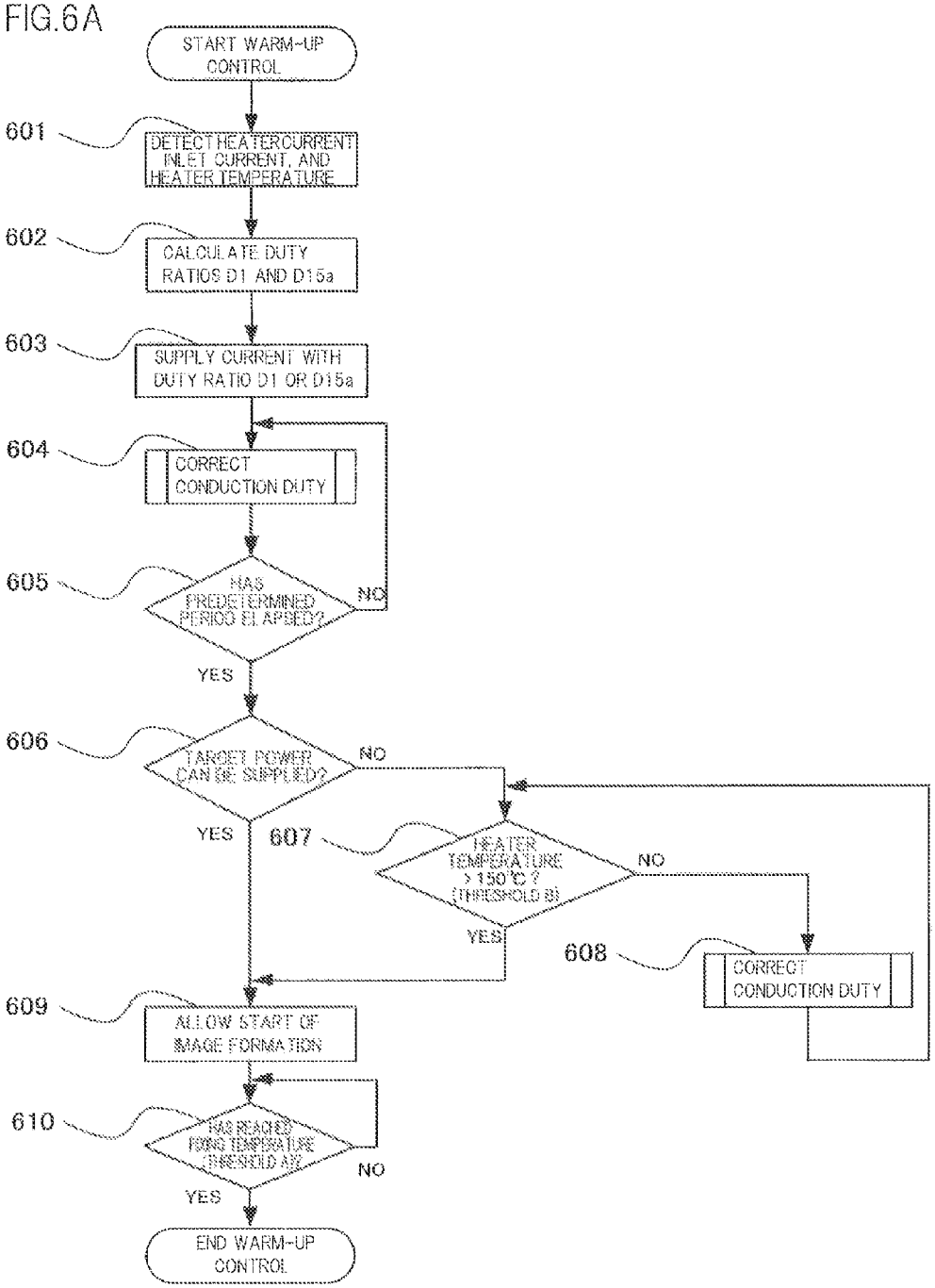
FIGS. 6A and 6B are diagrams illustrating the flow of warm-up control applied to a first embodiment of the present invention.
Figure 6B:
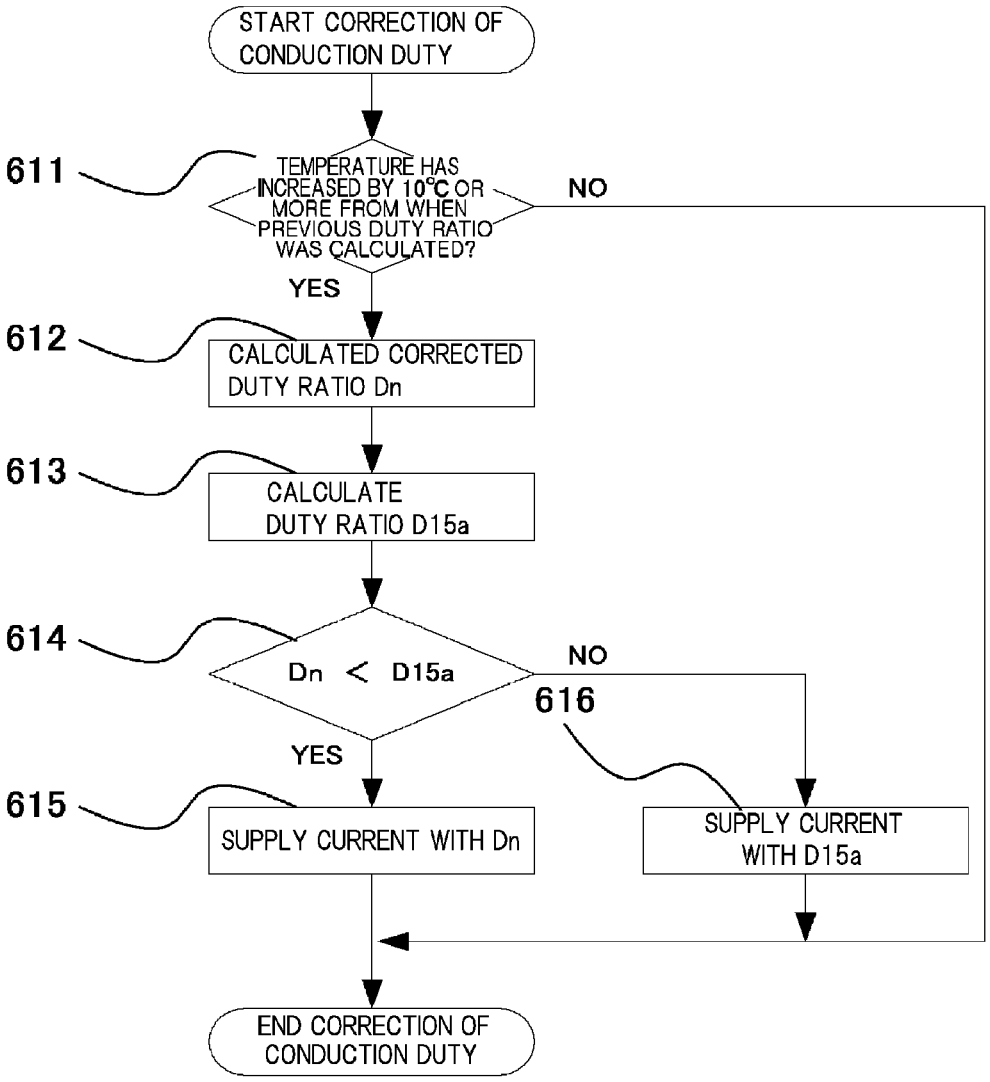
Figure 7A:
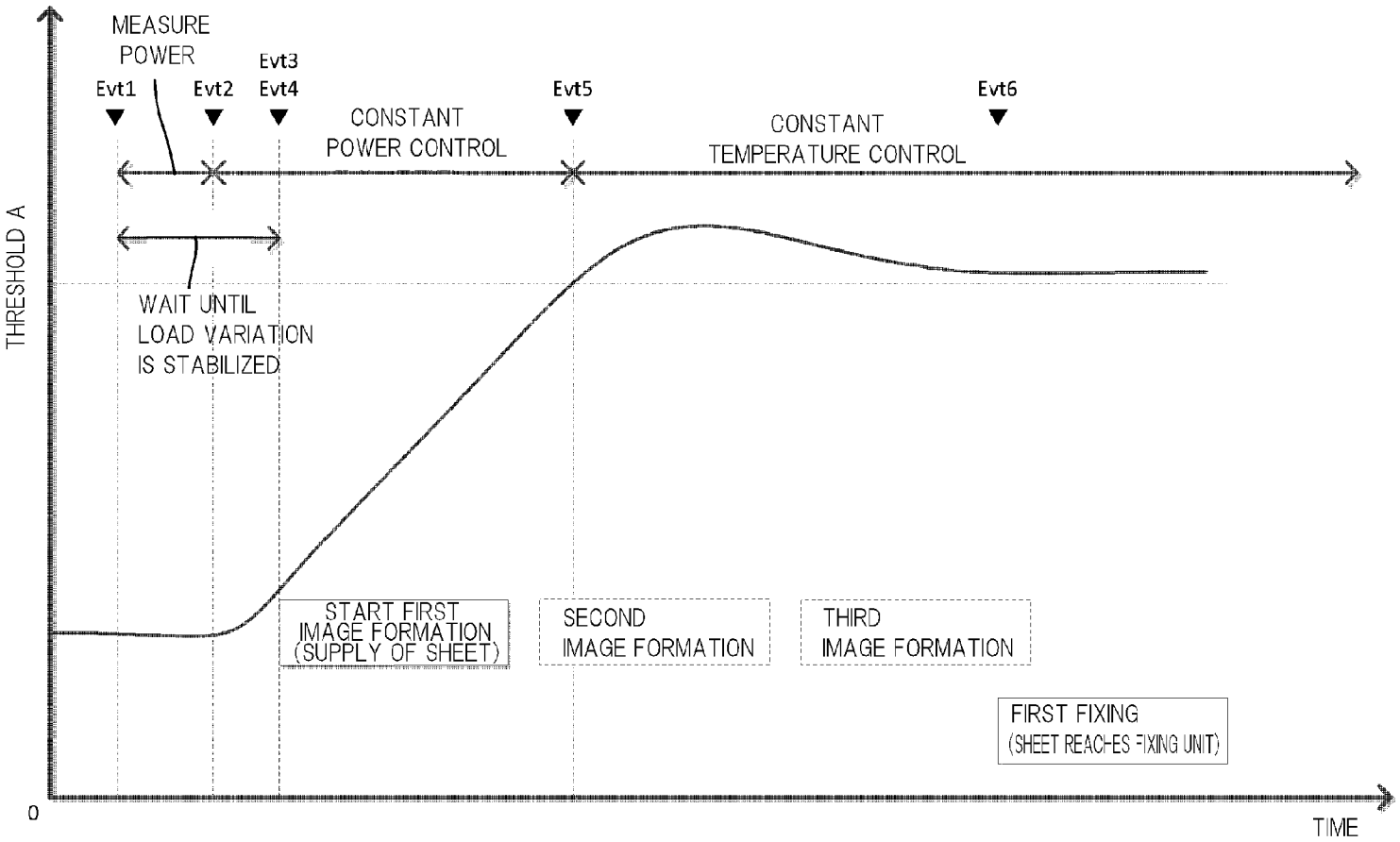
FIGS. 7A and 7B are timing charts of the first embodiment.
Figure 7B:
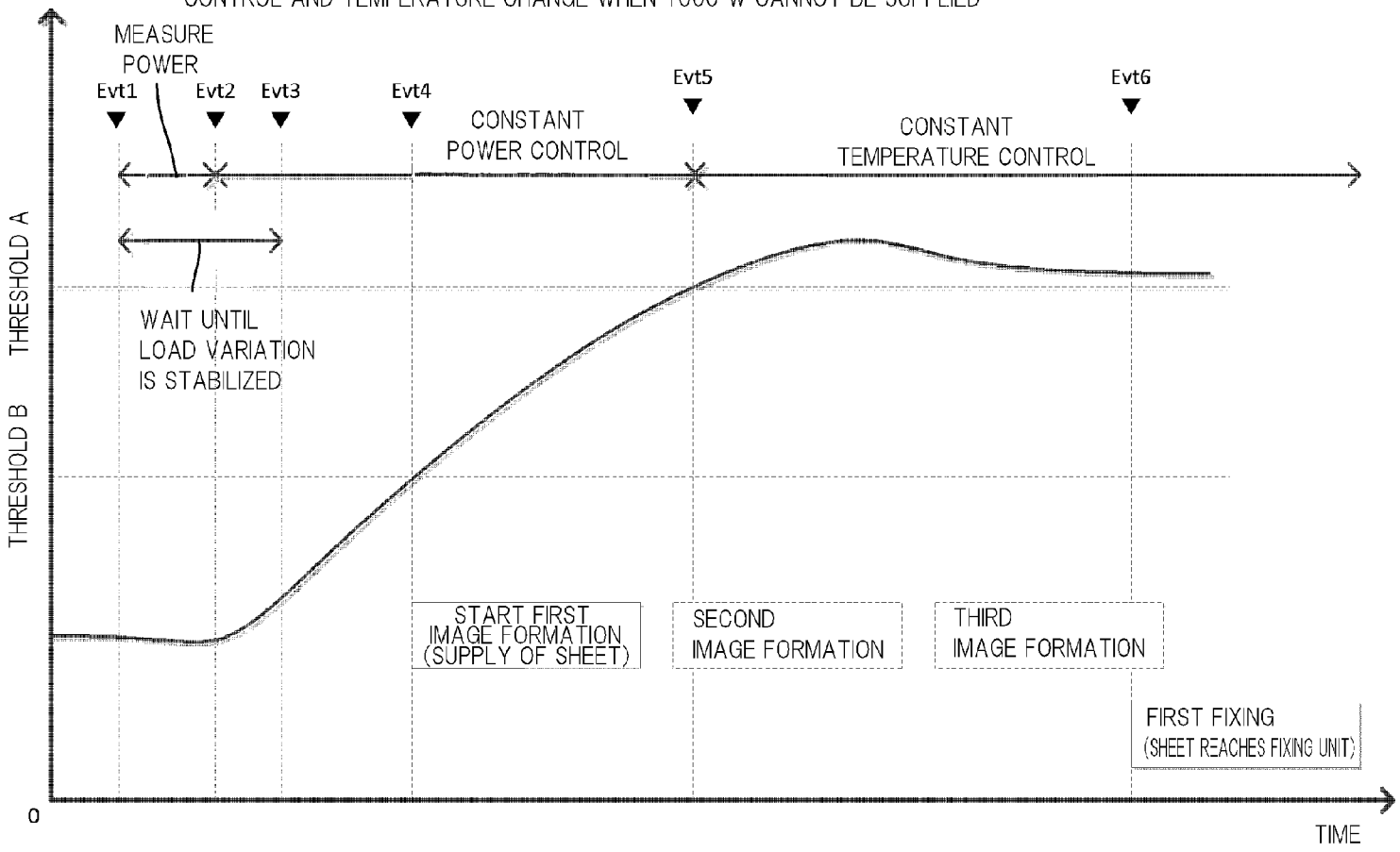

FIGS. 6A and 6B are flowcharts showing warm-up control according to the first embodiment. FIGS. 7A and 7B are timing charts corresponding to FIGS. 6A and 6B. The warm-up control will be described with reference to FIGS. 6A and 6B and FIGS. 7A and 7B.

Figure 5:
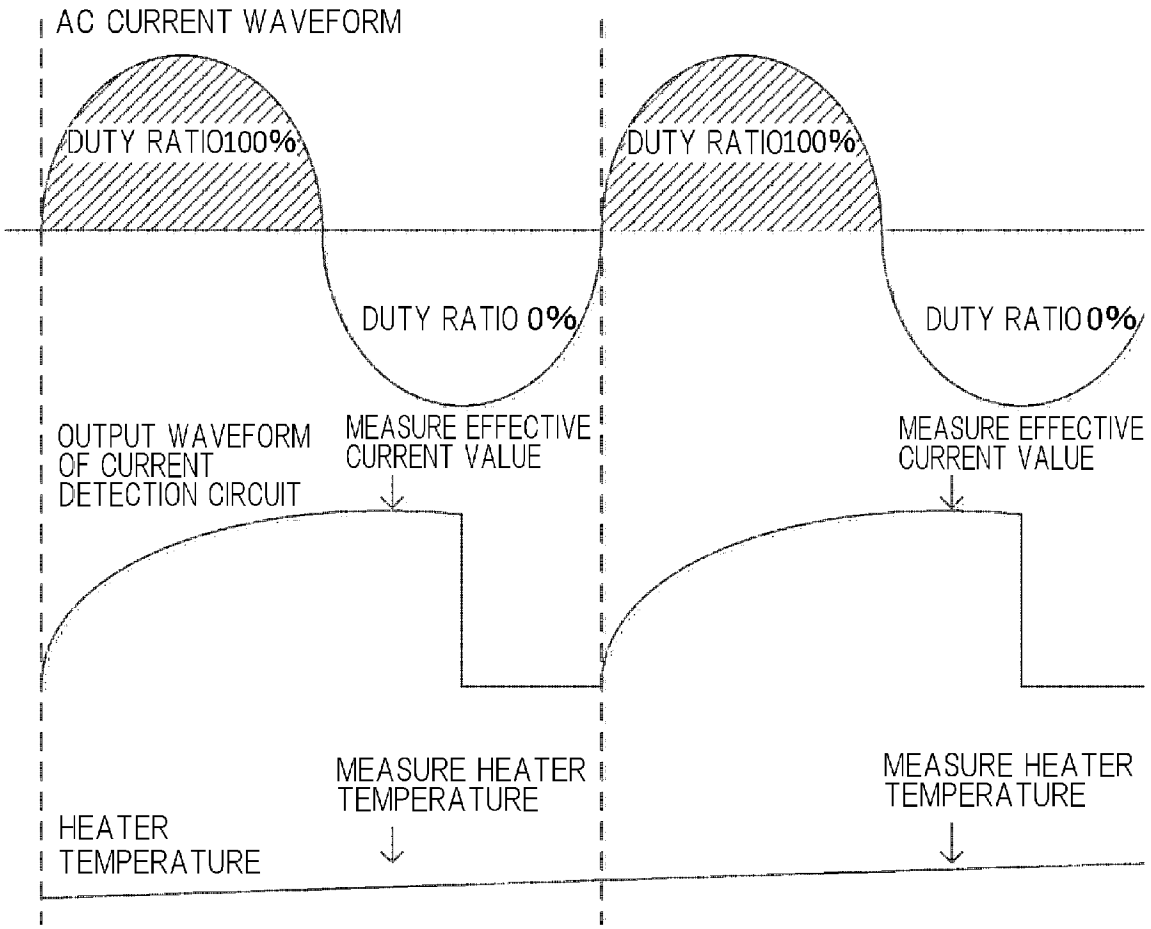
FIG. 5 is a diagram for illustrating detection of current and temperature implemented at the start of warm-up.

When warm-up control starts, the temperature of the heater 111 and the effective value of the heater current when flowing into the heater 111 are detected (step 601). First, the control unit 302 performs phase control at a duty ratio of 100% so that current flows for a period corresponding to ten AC current cycles. The detection results including the temperature of the heater 111 in the period corresponding to ten AC current cycles and the effective value (the effective value of the current detected by the heater current detection circuit 81) of the current flowing into the heater 111 are stored in the RAM 32*b* (period of Evt1 to Evt2 in FIGS. 7A and 7B). The heater current detection circuit 81 and the inlet current detection circuit 71 of the apparatus according to the present embodiment are circuits that detect the half-wave of the positive phase of an AC current. Thus, since it is only necessary for the half-wave of the positive phase of an AC current to flow into the heater, the waveform (the waveform at the time of current flow at a duty ratio of 100% as described above) of current flowing into the heater and the heater temperature in the temperature and current detection period change, as illustrated in FIG. 5. FIG. 5 illustrates two cycles of an AC current waveform. The waveform of FIG. 5 has a duty ratio of 50% in terms of one cycle of an AC current waveform and this duty ratio is not large enough to produce power with which the temperature of the heater increases abruptly.

Subsequently, the CPU 32 calculates the duty ratio corresponding to 1000 W, which is the predetermined target power using the heater temperature and the effective current value stored in the RAM 32*b* (step 602 and Evt1 to Evt2). First, the average (average temperature Tave (° C.)) of temperature data corresponding to ten waves and the average (average current value Iave (A)) of effective current value data stored in the RAM 32*b* are calculated. Subsequently, an average resistance value Rave (Ω) of the heater 111 in AC ten cycles in step 601 is calculated from the average temperature Tave (° C.), a predetermined heater reference resistance value R (Ω) (at 25° C.), and the temperature coefficient of resistance α ppm/° C. of the heater. The heater 111 used in the present embodiment is designed and produced so that the heater 111 has a positive temperature characteristics that R=9Ω (at 25° C.) and the temperature coefficient of resistance α=4500 ppm/° C.

When it is calculated that the average temperature Tave=15° C. and the average current value Iave=12 A, the initial value D1 of a duty ratio Dn corresponding to 1000 W is calculated as below.

Average resistance value Rave=9Ω+(15° C.−25° C.)×4500/1000000=8.955Ω,

Power $P1$ supplied during conduction duty of 100%=$Iave^2 \times Rave$=12 A×12 A×8.955Ω=1289.52 W.

Initial value $D1$ of duty ratio $Dn$ corresponding to 1000 W=1000 W/1289.52 W=77.548%.

Further, a duty ratio (upper-limit duty ratio) D15a for preventing the current from exceeding 15 A, which is the rated current value (predetermined current) of the commercial power supply is calculated (step 602). The duty ratio D15a is calculated according to the following equation from current Iix detected by the inlet current detection circuit 71 and the current Ifx detected by the heater current detection circuit 81 when current flows with the previous duty ratio Dx (in this case, the duty ratio of 100%).

$$D15a=(15(A)-Iix(A)+Ifx(A))/Ifx(A)\times Dx(\%)/100$$

In the period of Evt2 to Evt5 in FIG. 7, the duty ratios Dn (D1) and D15a are compared, and the current supply is continued at the duty ratio Dn if the duty ratio Dn does not exceed D15a. When the duty ratio Dn exceeds D15a, current supply is continued at the duty ratio D15a. That is, the duty ratio Dn required for supplying predetermined target power is determined based on the heater resistance value corresponding to the heater temperature and the current detected by the heater current detecting unit and is continuously corrected with a change in a resistance value. Power is supplied to the heater with the smaller duty ratio among the duty ratio Dn and the upper-limit duty ratio D15a. The duty ratio Dn is sequentially updated with an increase in the heater temperature. That is, the duty ratio is updated from the initial value D1 to Dn.

The CPU 32 performs phase control to start the current supply at the duty ratio D1 calculated as described above (step 603 and time Evt2). In step 604 (the period of Evt2 to Evt3 in FIGS. 7A and 7B), the duty ratio correction, which is control for maintaining the power supplied to the fixing unit to be constant within the range of the rated current is performed. FIG. 6B illustrates the process flow (flowchart) of correction of the duty ratio Dn.

As illustrated in FIG. 6B, in the duty ratio Dn correction flowchart, first, it is determined whether the temperature has increased by 10° C. or more from the time when the duty ratio was calculated previously (step 611). When the temperature has not increased by 10° C. or more, the duty ratio correction control ends without performing calculations for duty correction. When the temperature has increased by 10° C. or more, the duty ratio Dn corresponding to the temperature at that time is calculated (step 612). The duty ratio Dn is calculated as below.

When the temperature difference is 10° C. or more, a correction amount Da of the duty ratio Dn is calculated. First, a temperature difference between a present heater temperature Tnow and the heater temperature Tlast when the duty ratio Dn was calculate previously is calculated and a change in the resistance value is calculated. The amount of change (=Da) in the duty ratio associated with the change in the resistance value is calculated. For example, if Tlast=15° C. and Tnow=25° C., these values are calculated as below.

Amount of change in resistance value $R$dif=
(25° C.−15° C.)×4500/1000000=0.045Ω

Change in resistance value $R$pow=$R$dif/
($R$ave+$R$dif)=−0.045/9=0.005

Correction amount $Da$ of duty ratio=$D$1×
$R$pow=77.548×0.005=0.38774%

A corrected duty ratio Dn is calculated from the correction amount Da calculated as described above (step 612). The heater of the present embodiment has a positive resistance-temperature characteristics, i.e., the resistance value increases with an increase in temperature. If the resistance value increases and the duty ratio Dn determined previously is not changed, since the supplied power is smaller than 1000 W, the power deficiency is made up for by adding the correction amount Da to the duty ratio Dn as indicated by the following equation.

Corrected duty ratio $Dn$=Previous $Dn$+$Da$=77.548+
0.38774=77.93574%

The corrected duty ratio Dn calculated in this way is compared with the duty ratio D15a calculated in step 603 (steps 612 to 614). When the corrected duty ratio Dn is smaller than the duty ratio D15a, current is supplied with the former duty ratio, and otherwise with the latter duty ratio—the smaller duty ratio (steps 615 and 616).

Table 1 illustrates a resistance value R corresponding to the heater temperature T, the supplied power P1 when the duty ratio is continuously fixed to the initial value D1, the correction amount Da of duty ratio, the corrected duty ratio Dn, and the supplied power Pn at the corrected duty ratio. The respective values in the table are calculated under the preconditions 1 described below. As illustrated in Table 1, it is necessary to correct the duty ratio Dn in order to maintain the power of 1000 W.

TABLE 1

| T (° C.) | R (Ω) | P1 (W) | Da (%) | Dn (%) | Pn (W) |
|---|---|---|---|---|---|
| 0.00 | 8.89 | 1007.59 | −0.58 | 76.96 | 1000.00 |
| 5.00 | 8.91 | 1005.05 | −0.39 | 77.16 | 1000.00 |
| 15.00 | 8.96 | 1000.00 | 0.00 | 77.55 | 1000.00 |
| 25.00 | 9.00 | 995.00 | 0.39 | 77.94 | 1000.00 |
| 35.00 | 9.05 | 990.05 | 0.78 | 78.33 | 1000.00 |
| 45.00 | 9.09 | 985.15 | 1.17 | 78.72 | 1000.00 |
| 55.00 | 9.14 | 980.30 | 1.56 | 79.11 | 1000.00 |
| 65.00 | 9.18 | 975.49 | 1.95 | 79.50 | 1000.00 |
| 75.00 | 9.23 | 970.73 | 2.34 | 79.89 | 1000.00 |
| 85.00 | 9.27 | 966.02 | 2.73 | 80.28 | 1000.00 |
| 95.00 | 9.32 | 961.35 | 3.12 | 80.67 | 1000.00 |
| 105.00 | 9.36 | 956.73 | 3.51 | 81.06 | 1000.00 |

TABLE 1-continued

| T (° C.) | R (Ω) | P1 (W) | Da (%) | Dn (%) | Pn (W) |
|---|---|---|---|---|---|
| 115.00 | 9.41 | 952.15 | 3.90 | 81.45 | 1000.00 |
| 125.00 | 9.45 | 947.62 | 4.29 | 81.83 | 1000.00 |
| 135.00 | 9.50 | 943.13 | 4.68 | 82.22 | 1000.00 |
| 145.00 | 9.54 | 938.68 | 5.07 | 82.61 | 1000.00 |
| 155.00 | 9.59 | 934.27 | 5.46 | 83.00 | 1000.00 |

Precondition 1

Reference heater resistance value: 9Ω (at 25° C.)

Temperature coefficient of resistance: 4500 ppm/° C. (positive characteristics)

Detected effective current value at 15° C. and 100% conduction duty: 12 A

In FIGS. 7A and 7B, at predetermined time Evt3 (after a predetermined period from time Evt1), it is determined whether it is possible to immediately start image formation (supply of sheet) (steps 605 and 606). This determination is made based on the following criteria.

Condition 1: The duty ratio Dn corresponding to the heater temperature of 200° C. (fixable temperature or threshold temperature A) and the power of 1000 W when TCR correction is performed (when the heater resistance value corresponding to temperature is corrected) is 100% or smaller.

Condition 2: The duty ratio Dn corresponding to the heater temperature at time Evt3 and the power of 1000 W when TCR correction is performed is equal to or smaller than D15a which is calculated at time Evt3.

Condition 1 described above is a condition for determining whether 1000 W can be supplied to the heater at the time when the heater temperature has reached the threshold temperature A.

Condition 2 described above is a condition for determining whether the current flowing into the entire apparatus has exceeded the rated current value of 15 A at the constant power control period (Evt2 to Evt5). Since power $P=I^2R$, when the heater resistance value increases in the constant power control period (Evt2 to Evt5), the current flowing into the heater decreases gradually. Moreover, the time Evt3 is the time at which the operation of loads other than the fixing unit is stable (that is, the time at which the current flowing into loads other than the fixing unit reaches its maximum). Thus, if the current flowing into the entire apparatus is smaller than 15 A at the time Evt3, the current flowing into the entire apparatus will not exceed 15 A in the constant power control period. Thus, if the duty ratio Dn corresponding to the heater temperature at time Evt3 and the power of 1000 W when TCR correction is performed is equal to or smaller than D15, which is calculated at time Evt3, even when the duty ratio Dn increases after that, the relation of Dn D15a is satisfied in the period until Evt5.

When both Conditions 1 and 2 described above are satisfied (step 606: Yes), image formation (supply of sheet) is allowed at predetermined time (Evt4) (step 609). This is the case illustrated in FIG. 7A. In this example, the points in time Evt4 and Evt3 occur approximately simultaneously.

When at least one of Conditions 1 and 2 is not satisfied at time Evt3 (step 606: No), image formation (supply of sheet) is allowed to start at the time when the temperature of the fixing unit (heater) has reached a predetermined temperature (threshold temperature) (≤fixable temperature) B (step 607: Yes) (step 609). This is the case illustrated in FIG. 7B. In this example, the threshold temperature B is 150° C. In step 607, power is supplied continuously while repeatedly correcting the duty ratio as in step 604 until the heater temperature reaches 150° C. (steps 607 and 608).

After image formation is allowed to start (step 609), when the heater temperature reaches the fixable temperature (threshold A), the warm-up period ends (step 610) and the flow proceeds to constant temperature control of maintaining the heater temperature at a constant temperature (Evt5).

Here, the predetermined period (the period of Evt1 to Evt3) is a period that lasts until the operation of loads (actuators such as, for example, a photosensitive member driving motor or a developing roller driving motor) other than the fixing unit is stabilized after the supply of current to the heater starts (Evt1). In this embodiment, the predetermined period is 1.6 seconds.

As described above, with the control of the present embodiment, when it is determined that it is possible to supply target power continuously during the warm-up period, since it is possible to start image formation in a short time from the start of supply of power to the heater, it is possible to shorten FPOT. Moreover, when it is not possible to maintain the supplied power to be constant during the warm-up, it is possible to warm up the fixing unit without exceeding the rated current value.

Second Embodiment

An image-forming apparatus according to a second embodiment implements control while optimizing the start timing of image formation even when the power that can be supplied to a fixing unit is smaller than that when a print operation is performed with the apparatus only like when an optional device is connected to a sheet feeding unit or a sheet discharge unit, for example. The same constituent components as the first embodiment will not be described appropriately, and only the differences from the first embodiment will be described. The matters that are not described herein are the same as those of the first embodiment.

In the present embodiment, the target power illustrated in the first embodiment is corrected on the basis whether an optional device is installed, and the time Evt4 (that is, a predetermined time (predetermined period) at which image formation is allowed to start) illustrated in FIG. 7A is corrected on the basis whether the optional device is installed.

Figure 8A:
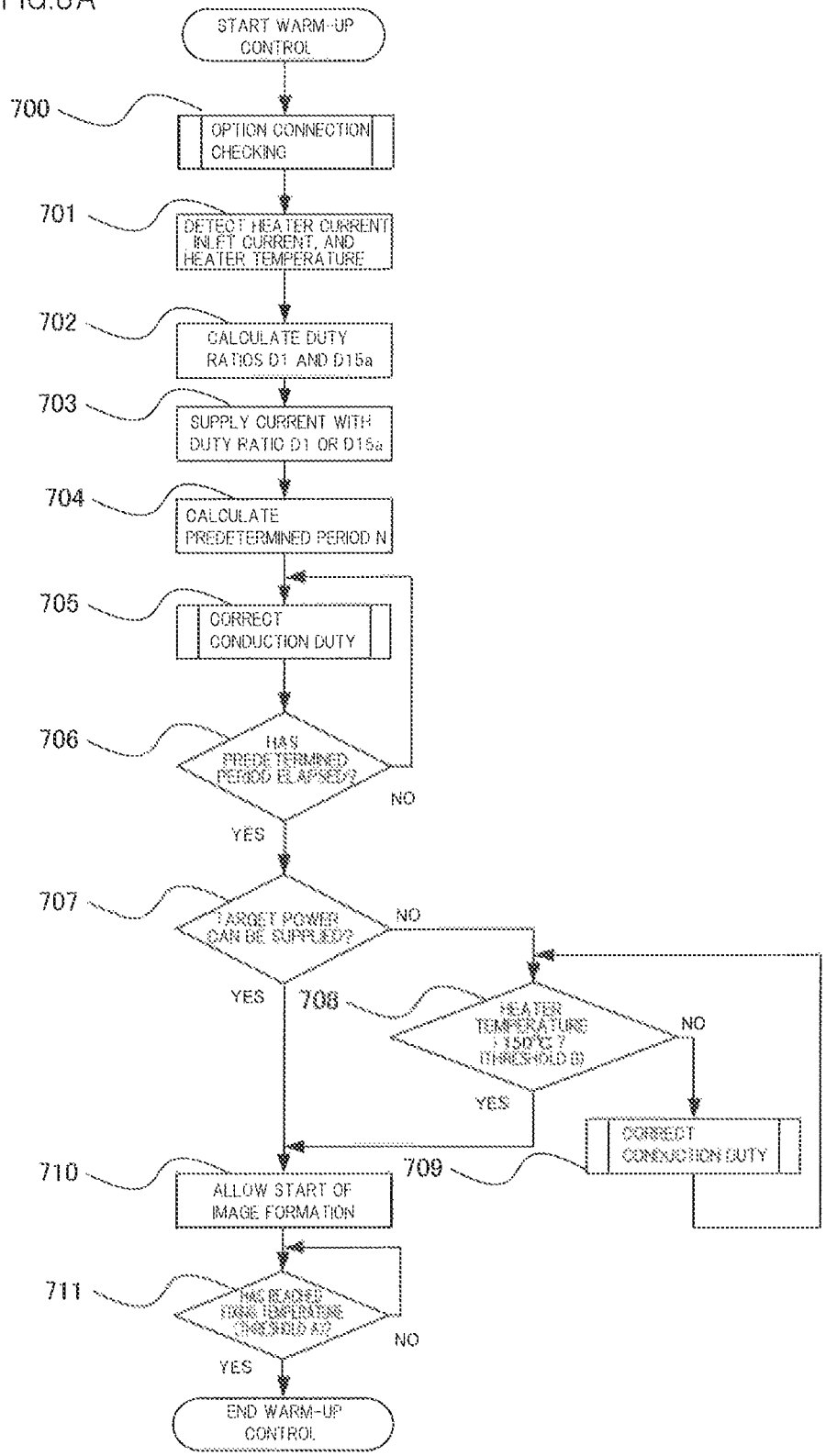
FIGS. 8A and 8B are diagram illustrating the flow of warm-up control applied to a second embodiment of the present invention.
Figure 8B:
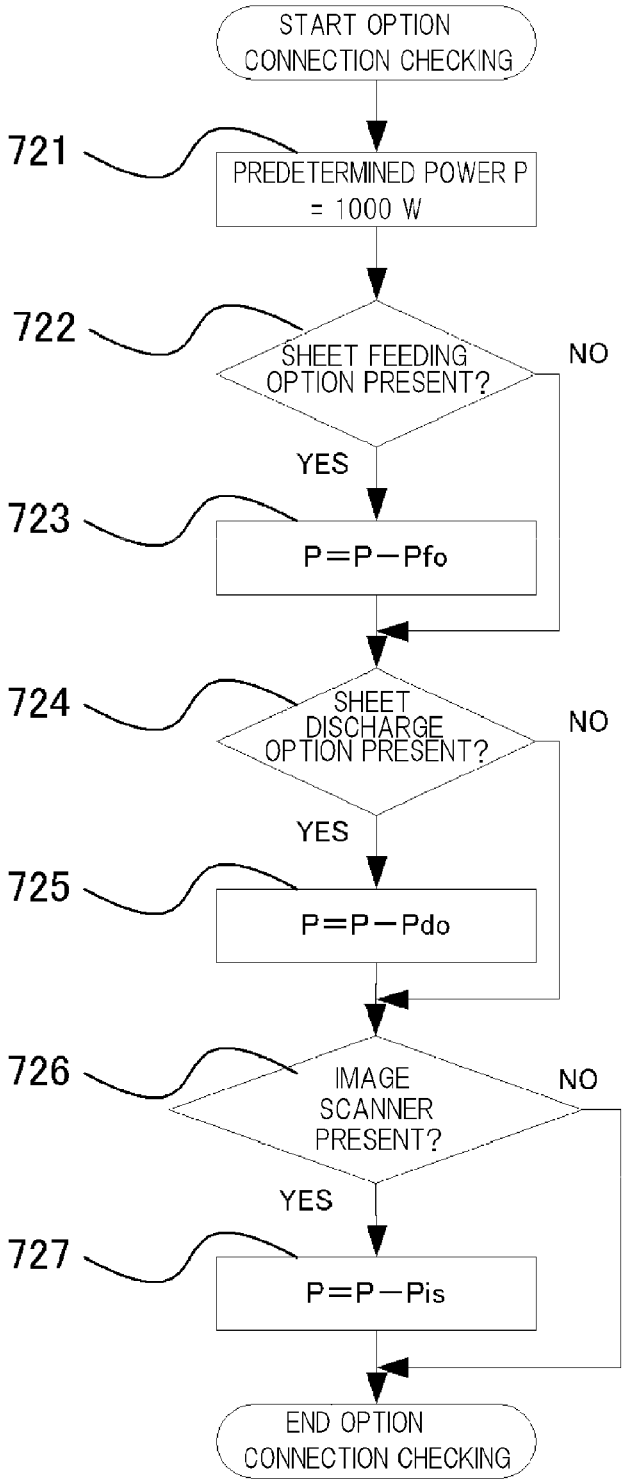

FIG. 8A illustrates the flowchart of warm-up control according to the second embodiment. In the present embodiment, when warm-up control starts, first, a connection state of an optional device is checked (step 700). In this example, it is checked whether various optional devices connectable to the image-forming apparatus are connected, and the target power P that can be supplied to the fixing unit during the warm-up control is changed. FIG. 8B illustrates the control flow of checking option connection.

A sheet feeding option, a discharge option, and an image scanner can be connected to the image-forming apparatus of the present embodiment, and the CPU 32 can check the connection state of the optional devices.

In the option connection checking step, first, the predetermined power P is set to 1000 W (step 721), and it is determined whether a device having a sheet feeding option is connected (step 722). When a device for a sheet feeding option is connected, power obtained by subtracting power Pfo that the sheet feeding option consumes from the predetermined power P is stored as P (step 723). Similarly, as for the device for the sheet discharge option and the image scanner, the connection state is checked (steps 724 and 726), and when connected, power obtained by subtracting the power (Pdo and Pis) consumed by the respective options from predetermined power P is stored as the target power P (steps 725 and 727). When the target power is calculated in step 700, steps 701 to 703 are performed in the same manner as the first embodiment (steps 601 to 603 of FIG. 6).

Subsequently, when it is determined that the target power can be supplied during the warm-up period, the time (predetermined period N) at which the image formation is allowed to start is calculated (step 704). The present embodiment illustrates an example in which an optional device having power consumption of 100 W is connected, and it is not possible to supply 1000 W to the fixing unit and 900 W is set to the target power P. The N is calculated according to the following equation from the amount of power Pt (Wh) required for increasing the fixing unit temperature to the fixable emperature, a predetermined period K (h) required for a sheet to reach the fixing unit 30 after the start of image formation, and the power P (W) (=900 W) supplied continuously to the fixing unit during the warm-up.

$$N=(P-(900\ \mathrm{W}\times K))/900\ \mathrm{W}$$

After that, the duty ratio is corrected and 900 W is supplied to the fixing unit until the calculated predetermined period N has elapsed (steps 705 and 706). The control (steps 707 to 711) after the elapse of the predetermined period N is the same as that of the first embodiment (steps 606 to 610 of FIG. 6), and a description thereof will not be provided.

As described above, according to the control of the present embodiment, by calculating the predetermined period N according to the power that can be supplied, it is possible to start image formation at an optimal time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-184681, filed Sep. 6, 2013, which is hereby incorporated by reference herein in its entirety.

What is claimed is:

1. An image-forming apparatus comprising:

an image forming unit that forms a toner image on a recording material;

a fixing unit that has a heater, the resistance value of which changes with an increase in temperature, and heats and fixes the toner image formed on the recording material to the recording material;

a control unit that controls the apparatus;

an inlet current detecting unit that detects current flowing into the entire apparatus; and a heater current detecting unit that detects current flowing into the heater, wherein when warming up the fixing unit to a fixable temperature, the control unit supplies power to the heater with the smaller duty ratio of:

an upper-limit duty ratio D15a of power supplied to the heater, the ratio being determined so that the current detected by the inlet current detecting unit does not exceed a predetermined current; and a duty ratio Dn which is determined based on the resistance value of the heater corresponding to the temperature of the heater and the current detected by the heater current detecting unit, and which is continuously corrected according to a change in the resistance value and is required for supplying predetermined target power, wherein when a determination is made that power is supplied continuously at the duty ratio Dn in a period in which the fixing unit is warmed up to the fixable temperature, the control unit allows a recording material to be supplied to the image forming unit at the time when a period in which power is supplied at the duty ratio Dn has reached a predetermined period, and wherein when a determination is made that a duty ratio of the power supplied to the heater reaches the upper-limit duty ratio D15a in the period in which the fixing unit is warmed up to the fixable temperature, the control unit allows the recording material to be supplied at a time later than the predetermined period.

2. The image-forming apparatus according to claim 1, wherein when a determination is made that the duty ratio of the power supplied to the heater reaches the upper-limit duty ratio D15a in the period in which the fixing unit is warmed up to the fixable temperature, the control unit allows the recording material to be supplied at a time when the temperature of the fixing unit has reached a predetermined temperature.

3. The image-forming apparatus according to claim 1, wherein the target power is set according to an optional device connected to the image-forming apparatus.

4. The image-forming apparatus according to claim 3, wherein the predetermined period is set according to the optional device connected to the image-forming apparatus.

5. The image-forming apparatus according to claim 1, wherein the fixing unit has a film that rotates while making contact with the toner image.

6. The image-forming apparatus according to claim 5, wherein the heater is in contact with an inner surface of the film.

7. A method of determining a timing at which a recording material is supplied to an image forming unit that is mounted on an image-forming apparatus, the method comprising:

an inlet current detecting step of detecting current flowing into an entire apparatus;

a heater current detecting step of detecting current flowing into a heater of a fixing unit that is mounted on the image-forming apparatus;

a step of determining an upper-limit duty ratio D15a of power supplied to the heater, the ratio being determined so that the current detected in the inlet current detecting step does not exceed a predetermined current;

a step of determining a duty ratio Dn, which is determined based on the resistance value of the heater corresponding to the temperature of the heater and the current detected in the heater current detecting step, and which is continuously corrected according to a change in the resistance value and is required for supplying predetermined target power; and a step of starting the supply of the recording material to the image forming unit at a predetermined timing when the duty ratio Dn is equal to or smaller than the upper-limit duty ratio D15a and starting the supply of the recording material to the image-forming apparatus at a timing later than the predetermined timing when the duty ratio Dn is larger than the upper-limit duty ratio D15a.

* * * * *